US005899611A

United States Patent [19]

Haneda et al.

[11] Patent Number: 5,899,611

[45] Date of Patent: May 4, 1999

[54] APPARATUS FOR FORMING AN IMAGE ON BOTH SIDES OF AN IMAGE RECEIVER

[75] Inventors: Satoshi Haneda; Yotaro Sato; Kunio Shigeta, all of Hachioji, Japan

[73] Assignee: Konica Corporation, Japan

[21] Appl. No.: 09/026,498

[22] Filed: Feb. 19, 1998

[30] Foreign Application Priority Data

Feb. 24, 1997 [JP] Japan ..... 9-039177

[51] Int. Cl.[6] ..... G03G 15/16

[52] U.S. Cl. ..... 399/309

[58] Field of Search ..... 399/302, 306, 399/308, 309, 400, 297, 350

[56] References Cited

U.S. PATENT DOCUMENTS

| | | | |
|---|---|---|---|
| 4,714,939 | 12/1987 | Ahern et al. | 399/309 |
| 5,070,371 | 12/1991 | Randall | 399/309 |
| 5,124,756 | 6/1992 | Stelter | 399/333 |
| 5,617,192 | 4/1997 | Tonomoto et al. | 399/263 |
| 5,678,161 | 10/1997 | Kurotaka et al. | 399/400 |
| 5,722,012 | 2/1998 | Saitoh | 399/400 |

*Primary Examiner*—Arthur T. Grimley
*Assistant Examiner*—William A. Noe
*Attorney, Agent, or Firm*—Jordan B. Bierman; Bierman, Muserlian and Lucas

[57] ABSTRACT

An apparatus for forming a toner image on both sides of a sheet, includes a photoreceptor on which a first toner image and a second toner image are formed by toner image forming devices; a second image carrying belt onto which the second toner image is transferred from the photoreceptor; a first transferring device to transfer the first toner image from the photoreceptor to a first side of the sheet; a second transferring device to transfer the second toner image from the second image carrying belt to a second side of the sheet; a fixing device having a first fixing roller for fixing the first toner image onto the first side of the sheet and a second fixing roller for fixing the second toner image onto the second side of the sheet, the first fixing roller coming in contact with the second fixing roller so as to form a nip section therebetween; the second image carrying belt having a flat belt surface on which the sheet is conveyed from the photoreceptor toward a separating section at which the sheet is separated from the second image carrying belt, and the second image carrying belt arranged in relation to the fixing device in such a manner that an extended plane from the flat belt surface crosses the first fixing roller at a point between the nip section and a rotation axis of the first fixing roller.

8 Claims, 9 Drawing Sheets

APPARATUS FOR FORMING AN IMAGE ON BOTH SIDES OF AN IMAGE RECEIVER

BACKGROUND OF THE INVENTION

The present invention relates to an image forming apparatus of an electrophotographic system which forms images by transferring onto a transfer material toner images formed on an image carrier and by fixing them on the transfer material in a copying machine, a printer or a facsimile machine, and in particular, to an image forming apparatus capable of forming images on any of the obverse side and the reverse side of a transfer material by transferring toner images formed on an image carrier onto the obverse side of the transfer material, or by transferring the toner images onto the reverse side of the transfer material after transferring them temporarily onto a toner image receptor.

In the case of two-sided copy, there has been employed a method wherein an image for one side of a transfer material formed on an image carrier is transferred and fixed on the transfer material, then the transfer material is stored temporarily in an intermediate tray, and then is fed out of the intermediate tray in synchronization with an image formed again on the image carrier so that the image may be transferred and fixed on the other side of the transfer material.

This two-sided copy apparatus has been less reliable in conveyance of a transfer material and has caused a paper jam because the transfer material needs to be fed into and fed out of an intermediate tray and it needs to pass through a fixing unit twice. In contrast to the foregoing, TOKKOSHOs 49-37538 and 54-28740 and TOKKAIHEIs 1-44457 and 4-214576 disclose a technology wherein fixing is conducted only once after forming toner images on both sides of a transfer material, and in particular, TOKKAIHEIs 1-44457 and 4-214576 disclose a method wherein a plurality of image forming means each being composed of an image carrier, a charging means, an image writing means and a developing means are arranged in parallel on a toner image receptor to form a two-sided copy of color images.

However, in two-sided color image forming disclosed by TOKKAIHEIs 1-44457 and 4-214576 mentioned above, image deteriorations such as color doubling or scattering and rubbing of toner are easily caused because color toner images each being different in color are superposed one by one on a toner image receptor, although conveyance of a transfer material is improved.

In contrast to this, inventors of the invention are studying, as they propose in TOKKAIHEIs 8-70322 and 8-70323, an image forming apparatus wherein a toner image formed on the first image carrying means (photoreceptor drum) is transferred onto the second image carrying means (toner image receptor) temporarily, then a toner image is formed again on the photoreceptor drum, and the toner image on the toner image receptor is transferred as a reverse side image onto the reverse side of the transfer material conveyed on the toner receptor, while the toner image formed again on the photoreceptor is transferred as an obverse side image onto the obverse side of the transfer material, and then the transfer material is separated from the toner image receptor and toner images on the both sides of the transfer material are fixed by a fixing means to form two-sided images. This method, however, has a problem that a crease is caused on a transfer material which enters a nip portion of a fixing means when the transfer material is conveyed to the fixing means, and thereby the toner images on both sides of the transfer material can not be fixed satisfactorily. There is further caused a problem that the transfer material is lifted to touch the second transfer means and a transfer material separating means when it is separated from the second image carrying means in a belt shape and is conveyed to the fixing means, resulting in disturbed toner image on the obverse image.

The first object of the invention is to solve the problems mentioned above and to provide an image forming apparatus wherein a transfer material is caused to enter a fixing means without being creased and is less brought into contact with the second transfer means or with a transfer material separating means when the transfer material is conveyed from the second belt-shaped transfer means to a fixing means.

Another problem to be solved by the invention will be explained as follows. Namely, the second image carrier (toner image receptor) is provided to be adjacent to or to be in contact with a photoreceptor drum, a driving roller is provided at the downstream side and a driven roller is provided at the upstream side both from the position where the toner image receptor is provided to be close to or to be in contact with the photoreceptor drum in the rotary direction of the toner image receptor, respectively to be inscribed, and a transfer material charging means (paper charging unit) which makes a transfer material to be attracted to the toner image receptor and the second image carrying means cleaning blade (toner image receptor cleaning blade) of the second image carrying means cleaning means which comes in contact with the toner image receptor to remove the toner remaining thereon after transferring are provided so that they face the driven roller through the toner image receptor. However, the shock caused when the toner image receptor cleaning blade comes in contact with or leaves the toner image receptor makes the toner image receptor to have uneven rotation which causes a blurred image on a toner image of the obverse image or a reverse image to be transferred onto a transfer material that is conveyed by the toner image receptor, which is a problem.

There is further caused a problem that a paper charging unit arranged in the vicinity of the toner image receptor cleaning means is contaminated by toner spattered from the toner image receptor cleaning means.

The second object of the invention is to solve the problems mentioned above and to provide an image forming apparatus wherein uneven rotation of the second image carrying means caused by the shock generated when the second image carrying means cleaning blade comes in contact with or leaves the second image carrying means is prevented, and contamination of a transfer material charging means caused by toner spattered from the second image carrying means cleaning means is prevented.

SUMMARY OF THE INVENTION

The first object of the Invention is achieved by the use of an image forming apparatus which has a first image carrying means and carries a first toner image and a second toner image, both formed by a toner image forming means. The first image carrying means transfers the second toner image onto a second belt-shaped image carrying means. A first transfer means transfers the first toner image from the first image carrying means onto the obverse side of the transfer material, and a second transfer means transfers the second toner image from the second image carrying means onto the reverse side of the transfer material. A fixing means fixes both the first and second images on the two sides of the transfer material.

An extension of the horizontal plane of the belt of the second image carrying means is between the center axis of a first roller for fixing the first toner image and the nip portion formed by the first roller and a second roller for fixing the second toner image. The intersection of the extended plane and the first roller is closer to the center axis of the first roller than to the nip portion.

The second object is attained by an image forming apparatus having therein the first image carrying means which carries a toner image formed by a toner image forming means, the second belt-shaped image carrying means onto which the toner image carried by the first image carrying means is transferred to be carried thereon, the first transfer means which transfers the toner image carried by the first image carrying means onto the obverse side of a transfer material, the second transfer means which transfers the toner image carried by the second image carrying means onto the reverse side of the transfer material, and a fixing means which fixes toner images transferred on both sides of the transfer material, wherein the second image carrying means is provided to be adjacent to or to be in contact with the first image carrying means, and a driving roller is arranged at the downstream side of the position to be close to or to be in contact in the rotary direction of the second image carrying means, a driven roller which faces a transfer material charging means that causes the transfer material to be attracted to the second image carrying means is arranged at the upstream side, and a guide roller is arranged at the downstream side of the driven roller in the rotary direction of the second image carrying means, all to be inscribed in the second image carrying means in a belt shape, and a cleaning blade for the second image carrying means provided on a cleaning means for the second image carrying means which cleans the second image carrying means is arranged to face the guide roller.

DETAILED DESCRIPTION OF THE PREFERRED EMBODIMENT

An embodiment of the invention will be explained as follows. Incidentally, the description of the invention does not limit the technical scope and meanings of terminology in the invention. Further, a conclusive explanation in the embodiment of the invention does not limit meanings of terminology and technical scope of the invention but shows a best mode. In the explanation of the following embodiment, an image to be transferred onto the surface (obverse side or upper side of a transfer material) of a transfer material on the side facing the first image carrying means in the transfer area when transferring a color toner image onto a transfer material is called an obverse image, and an image to be transferred onto the surface (reverse side or lower side of a transfer material) on the other side of the transfer material is called a reverse image. Though an image forming apparatus explained in the following embodiment is a two-sided image forming apparatus wherein a belt-shaped transfer means is provided, and a belt-shaped member is used to form on both sides of a transfer material toner images which are then collectively fixed, the invention is not limited to the two-sided image forming apparatus, and single-side copy by means of the first image carrying means or the second image carrying means can be conducted. The invention can be applied preferably to an image forming apparatus wherein an image writing means is provided inside the first image carrying means. However, the invention is not limited to this color image forming apparatus, but can also be applied to an image forming apparatus wherein an image writing means is provided outside the first image carrying means.

Figure 1:
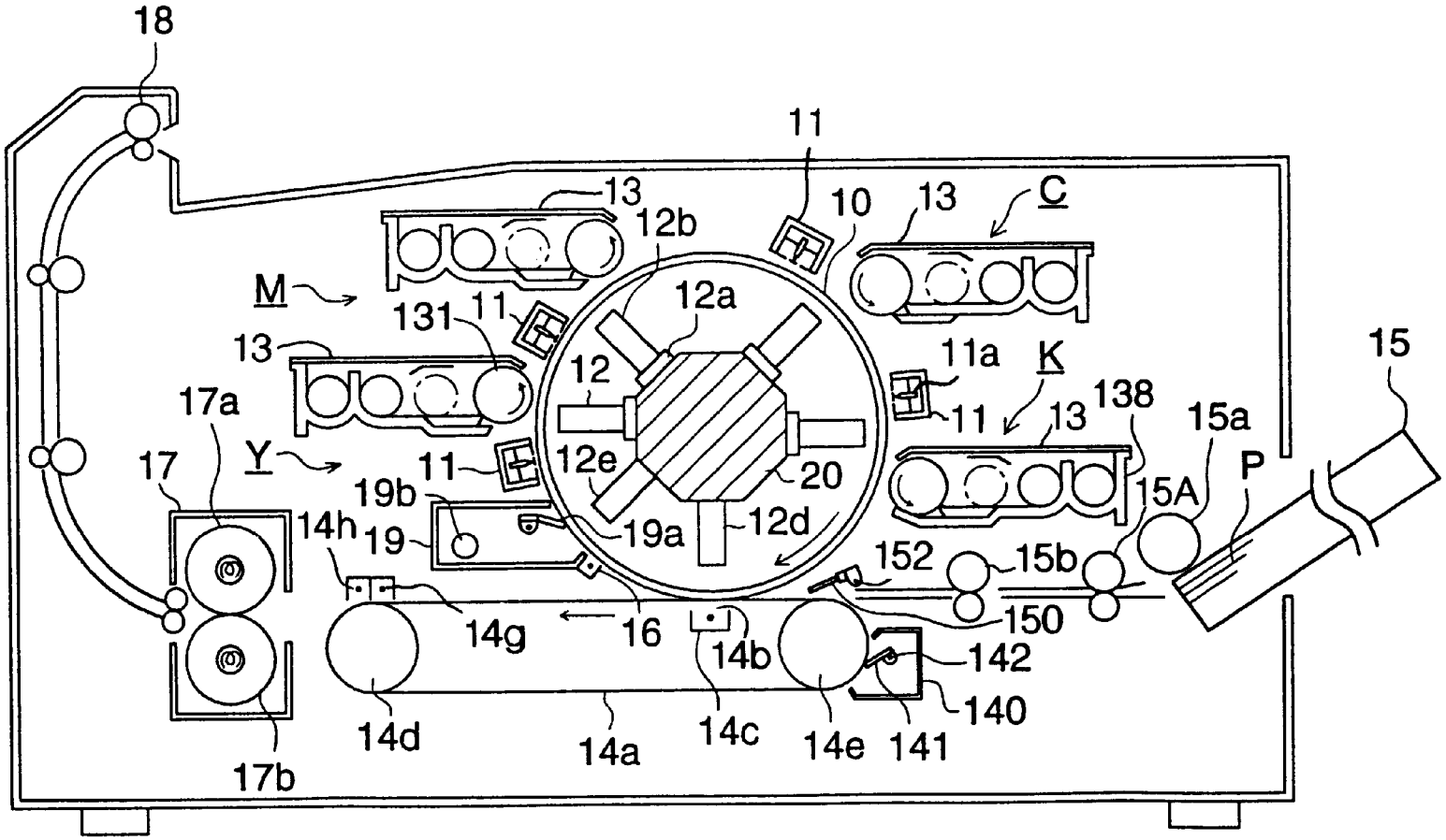
FIG. 1 is a sectional structure diagram of a color image forming apparatus showing an embodiment of an image forming apparatus related to the invention.
Figure 3:
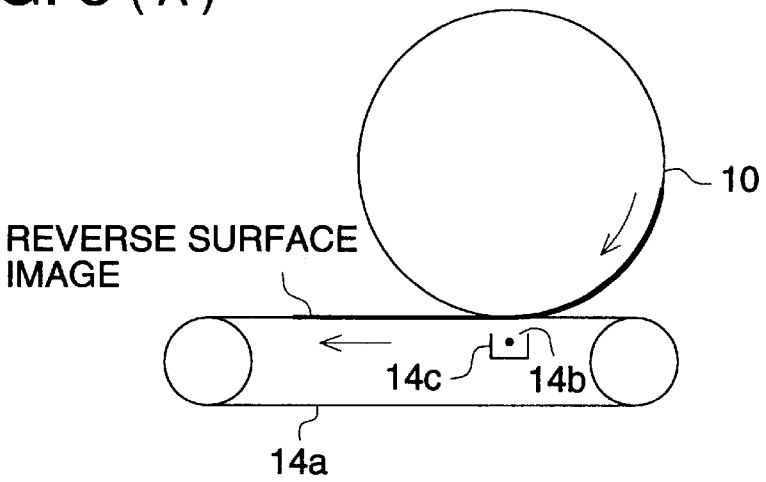
FIGS. 3(A) to 3(C) are diagrams showing how toner images on both sides are formed in an image forming apparatus related to the invention.
Figure 3:
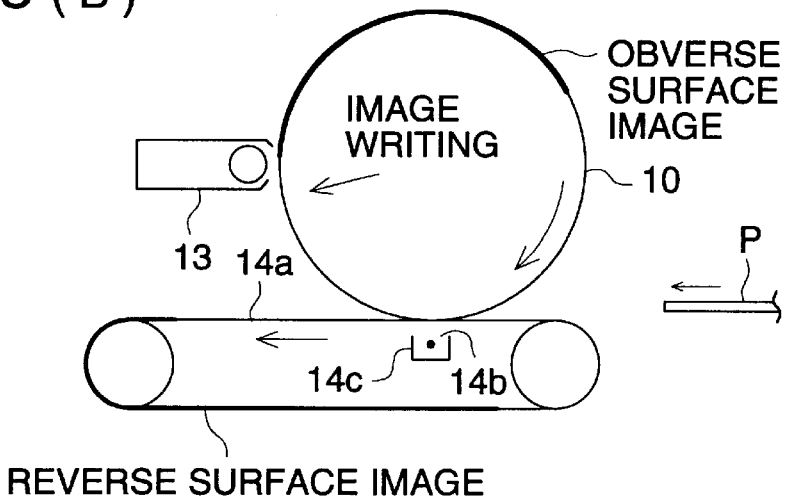
Figure 3:
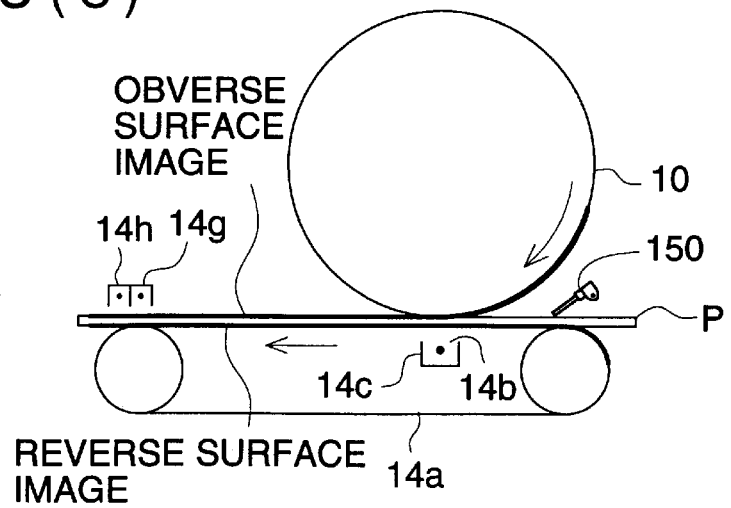
Figure 4:
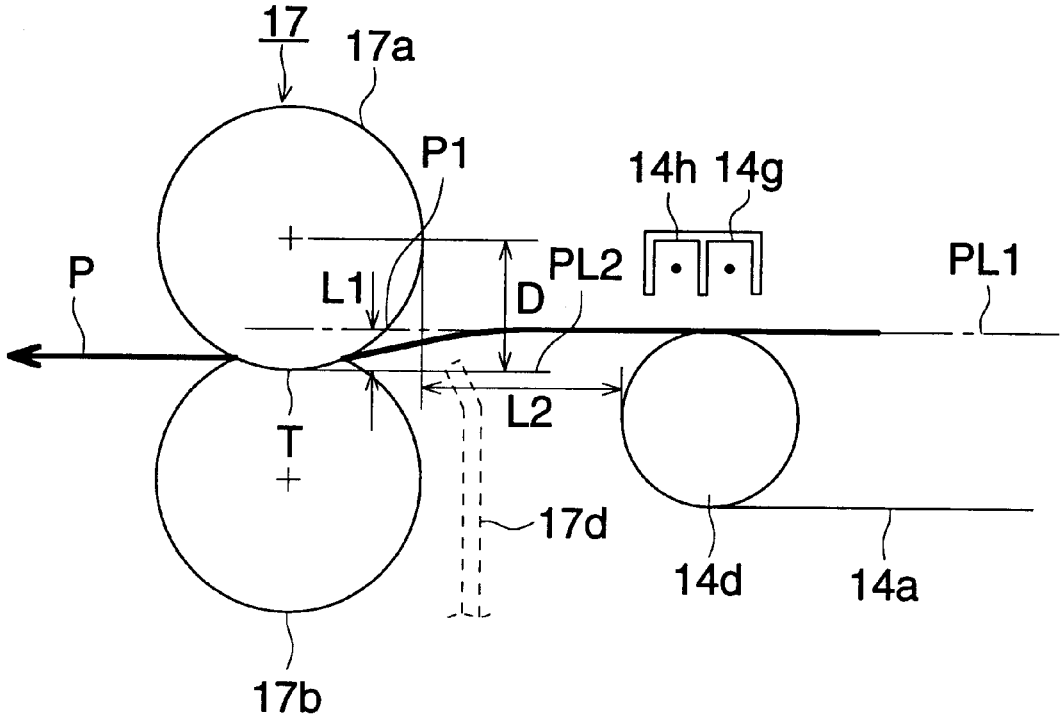
FIG. 4 is a diagram showing the positional relation between the second image carrying means and a fixing means.
Figure 5:
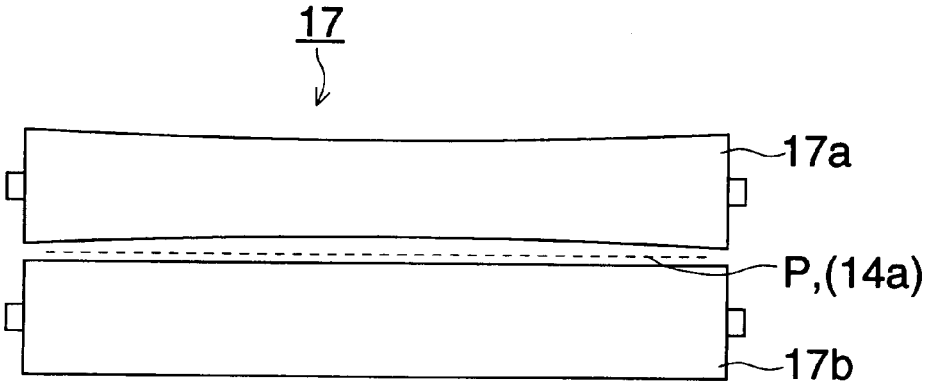
FIG. 5 is a diagram showing shapes of rollers of the fixing means.
Figure 6:
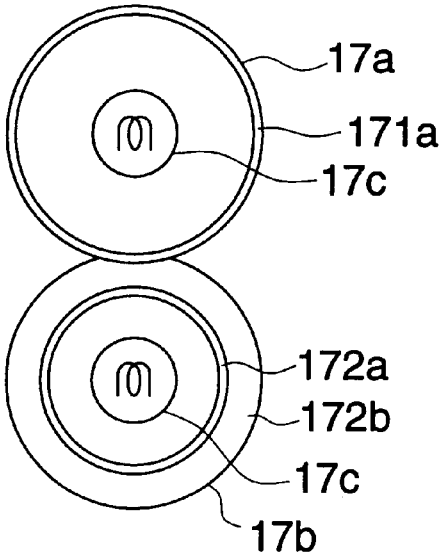
FIG. 6 is a diagram showing structures of rollers of the fixing means.

Image forming process and each structure in an embodiment of an image forming apparatus related to the invention will be explained as follows, referring to FIGS. 1 6. FIG. 1 is a sectional structure diagram of a color image forming apparatus showing an embodiment of an image forming apparatus related to the invention, FIG. 2 is a lateral section of the first image carrying means in FIG. 1, FIG. 3 is a diagram showing how toner images on both sides are formed in an image forming apparatus related to the invention, FIG. 3(A) is a diagram showing how toner image formed on the first image carrying means are transferred onto the second image carrying means to form a reverse image, FIG. 3(B) is a diagram showing how to form an obverse image on the first image carrying means in synchronization with the reverse image on the second image carrying means, FIG. 3(C) is a diagram showing two-sided image forming on a transfer material, FIG. 4 is a diagram showing the positional relation between the second image carrying means and a fixing means, FIG. 5 is a diagram showing shapes of rollers of the fixing means, and FIG. 6 is a diagram showing structures of rollers of the fixing means.

In FIG. 1, the numeral 10 represents a photoreceptor drum which is an image carrying means, 11 represents scorotron charging units, one for each color; 12 represents an exposure optical system which is an image writing means for each color; 13 represents developing units which are developing means for each color; 14*a* represents a toner image receptor which is the second image carrying means, 14*c* represents a transfer unit which is the first transfer means, 14*g* represents a reverse side transfer unit which is the second image carrying means, 14*h* represents a paper separation AC neutralizing unit which is a transfer material separating means, and 17 represents a fixing unit which is a fixing means.

Photoreceptor drum 10 which is the first image carrying means is one wherein a photoconductive layer such as a transparent conductive layer, an a-Si layer or an organic photoconductive layer (OPC) is formed on the outer circumferential surface of a cylinder-shaped base body which is formed by, for example, a transparent member such as optical glass or transparent acrylic resins, and it is rotated, with its conductive layer grounded, in the clockwise direction shown with an arrow mark in FIG. 1.

Figure 2:
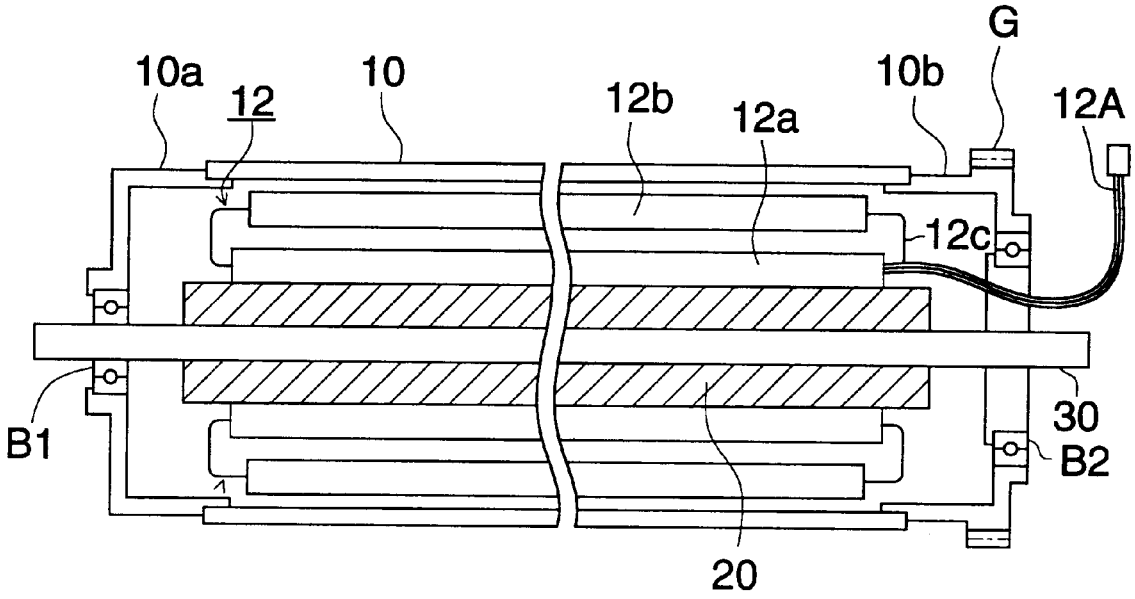
FIG. 2 is a lateral section of the first image carrying means in FIG. 1.

As shown in FIG. 2, the photoreceptor drum 10 is rotatably supported on drum shaft 30 fixed on the apparatus main frame in a way that flange members 10*a* and 10*b* engaging with the photoreceptor drum at its ends to be fixed are supported by bearing B1 and B2 engaged respectively with the flange members 10*a* and 10*b*, and the photoreceptor drum is rotated at a constant speed in the prescribed direction when gear G united solidly with flange member 10*b* is engaged with an unillustrated driving gear located on the apparatus main frame to be driven. The symbol 12A represents a lead wire coming from a light emitting diode (LED) of an image writing means stated later.

In the present embodiment, four sets each being composed of scorotron charging unit 11 which is a charging means for each color, exposure optical system 12 which is an image writing means for each color, and developing unit 13 which is a developing means for each color are provided for image forming process for colors of yellow (Y), magenta (M), cyan (C) and black (K), and they are arranged in the order of Y, M, C and K in the rotary direction of photoreceptor drum 10 shown with an arrow mark in FIG. 1.

The scorotron charging unit 11 which is a charging means for each color has therein a control grid kept at prescribed voltage respectively and discharge electrode 11*a* composed, for example, of a sawtooth electrode, and is mounted to face a photoconductive layer of photoreceptor drum 10 to conduct charging operation (negative charging in the present embodiment) by means of corona discharging with polarity which is the same as that of toner and thereby to give uniform voltage to photoreceptor drum 10. As discharging electrode 11*a*, other electrodes such as a wire electrode and an asicular electrode can also be used.

Exposure optical system 12 which is an image writing means for each color is arranged inside the photoreceptor drum 10 in a way that the exposure position on the photoreceptor drum 10 is located at the downstream side of the scorotron charging unit 11 for each color stated above in the rotary direction of the photoreceptor drum 10. Each exposure optical system 12 is mounted on holding member 20 with linear exposure element 12*a* wherein a plurality of LEDs (light emitting diode) serving as emission elements for imagewise exposure arranged in the primary scanning direction to be in parallel with an axis of the photoreceptor drum 10 to be an array are arranged and light-converging photoconductor (also called SELFOC lens array in trade name) 12*b* serving as an image-focusing element both structured as an exposure unit mounted on lens holder 12*c*. On the holding member 20, there are attached, besides the exposure optical system 12 for each color, uniform exposure unit 12*e* and transfer-overlapping exposure unit 12*d* which are integrally housed inside the base body of the photoreceptor drum 10. The exposure optical system 12 for each color applies an imagewise exposure to the reverse side of a photoconductive layer of the photoreceptor drum 10 in accordance with image data for each color read by a separate reading unit and stored in a memory to form an electrostatic latent image on the photoreceptor drum 10. As exposure element 12*a*, those wherein plural light emitting elements are arranged to be an array such as FL (fluorophor luminescence), EL (electro luminescence), and PL (plasma discharge) may also be used in addition to the foregoing. Incidentally, with regard to a wavelength for emission for imagewise exposure light, those being in a range of 780–900 nm and having high permeability for Y, M and C toners are usually used. However, in the present embodiment, wavelengths ranging from 400 nm to 780 nm which do not have sufficient permeability for color toner can also be used because of the system to apply imagewise exposure to the reverse side of a photoconductive layer in the present embodiment.

Developing unit 13 representing a developing means for each color is provided with cylindrical developing sleeve 131 made of non-magnetic stainless steel or aluminum material having wall thickness of 0.5–1 mm and outside diameter of 15–25 mm, for example, which is kept to be a prescribed distance away from the photoreceptor drum 10 and rotates with the photoreceptor drum 10 and with developer casing 138, and houses therein single-component or two-component developing agents for yellow (Y), magenta (M), cyan (C) and black (K). Each developing unit 13 is kept by an unillustrated stopper roll to be in non-contact with photoreceptor drum 10 keeping a prescribed clearance of 100–500 $\mu$m, for example, and it conducts non-contact reversal development when developing bias wherein DC voltage and AC voltage are superimposed is impressed on the developing sleeve 131 to form toner images on the photoreceptor drum 10.

Toner Image receptor 14*a* representing the second image carrying means is a seamless belt of a two-layer structure wherein a fluorine coating with a thickness of 5–50 $\mu$m serving as a toner filming preventing layer is provided on the outer side of a semiconductive base body film having a thickness of 0.1–1.0 mm and surface and volume resistivity of $10^6$–$10^{12}$ $\Omega$·cm in which conductive materials are dispersed in engineering plastic such as denaturated polyimide, thermosetting polyimide, ethylene-tetrafluoroethylene copolymer, polyfluorovinylidene and nylon alloy, for example. As a base body, semiconductive rubber belt with a thickness of 0.5–2.0 mm in which conductive materials are dispersed in silicone rubber or urethane rubber can also be used besides the foregoing. The toner image receptor 14*a* is trained about driving roller 14*d* and driven roller 14*e* and is rotated in the counterclockwise direction shown with an arrow mark in FIG. 1.

Transfer unit 14*c* representing the first transfer means is provided to face photoreceptor drum 10 through toner image receptor 14*a*, and it forms transfer area 14*b* between the toner image receptor 14*a* and the photoreceptor drum 10. DC voltage whose polarity is opposite to that of toner (positive polarity in the present embodiment) is impressed on the transfer unit 14*c* to form transfer electric field in transfer area 14*b*, and thereby toner images on the photoreceptor drum 10 are transferred onto the toner image receptor 14*a* or onto the surface of a transfer material.

Reverse side transfer unit 14*g* representing the second transfer means is provided to face driving roller 14*d* through toner image receptor 14*a*, and it transfers toner images on the toner image receptor 14*a* onto the reverse side of a transfer material when DC voltage having polarity opposite to that of toner (positive polarity in the present embodiment) is impressed thereon.

Paper separation AC neutralizing unit 14*h* representing a transfer material separating means is provided on the end portion of the toner image receptor 14*a* closer to fixing unit 17, and it separates a transfer material conveyed by the toner image receptor 14*a* when DC voltage having polarity identical to that of toner (positive polarity in the present embodiment) is impressed thereon.

Fixing unit 17 representing a fixing means is composed of two rollers including fixing roller 17*a* serving as an obverse side image fixing roller having therein a heater and pressure roller 17*b* serving as a reverse side image fixing roller having therein a heater, and heat and pressure generated between the fixing roller 17*a* and the pressure roller 17*b* fix toner sticking to the obverse side and toner sticking to the reverse side of a transfer material.

Image forming process will be explained next.

At the start of image recording, photoreceptor drum 10 is rotated in the clockwise direction shown with an arrow mark in FIG. 1 by an unillustrated photoreceptor driving motor, and simultaneously with this, charging operation of scorotron charging unit 11 for yellow (Y) arranged on the left side of the photoreceptor drum 10 starts giving voltage to the photoreceptor drum 10.

The photoreceptor drum 10, after being given voltage, starts to be subjected to image writing by exposure optical system 12 for Y in accordance with electric signals corresponding to image data of the first color signal, namely of Y, and when the photoreceptor drum 10 rotates, an electrostatic latent image corresponding to Y image in an image of an original is formed on the photoconductive layer on the surface of the photoreceptor drum 10.

The latent image mentioned above is subjected to reversal development conducted by developing unit 13 for Y under the non-contact condition, thus, a toner image of yellow (Y) is formed as the photoreceptor drum 10 rotates.

Then, charging operation of scorotron charging unit 11 for magenta (M) positioned above the developing unit 13 for Y applies voltage on the toner image of Y formed on the photoreceptor drum 10, and image writing by means of electric signals corresponding to the second color signals, namely corresponding to image data for M is conducted on the photoreceptor drum 10 by exposure optical system 12 for M, thus, a toner image of magenta (M) is formed to be superposed on the toner image of yellow (Y) through non-contact reversal development conducted by developing unit 13 for M.

In the same process, a toner image for cyan (C) corresponding to the third color signals is formed to be superposed by scorotron charging unit 11 for cyan (C), exposure optical system 12 for C and developing unit 13 for C all located at the right side of the photoreceptor drum 10, and further, a toner image for black (K) corresponding to the fourth color signals is formed in succession to be superposed on the aforesaid toner images by scorotron charging unit 11 for black (K), exposure optical system 12 for K and developing unit 13 for K all located below the developing unit 13 for C, thus, superposed color toner images respectively for yellow (Y), magenta (M), cyan (C) and black (K) are formed on the circumferential surface of the photoreceptor drum 10 while it makes one turn (toner image forming means).

Image writings on a photoconductive layer of the photoreceptor drum 10 by means of exposure optical systems 12 for Y, M, C and K are conducted from the inside of the drum through the transparent base body mentioned above. Therefore, image writings for the second, third and fourth color signals can be conducted without being affected by the toner image formed previously at all, which makes it possible to form latent images which are the same as the image corresponding to the first color signal.

The superposed color toner images formed on the photoreceptor drum 10 representing the first image carrying means to be a reverse image through the aforesaid image forming process are collectively transferred onto toner image receptor 14*a* representing the second image carrying means provided to be adjacent to or to be in contact with the photoreceptor drum 10 by transfer electric field formed by transfer unit 14*c* representing the first transfer means at transfer area 14*b* (FIG. 3(A)). In this case, uniform exposure by means of transfer-overlapping exposure unit 12*d* provided inside the photoreceptor drum 10 is carried out for satisfactory transferring.

Toner staying on the circumferential surface of the photoreceptor drum 10 after transferring is subjected to neutralizing conducted by photoreceptor drum AC neutralizing unit 16, and then arrives at cleaning unit 19 representing an image carrier cleaning means to be removed by cleaning blade 19*a* made of rubber material which is in contact with the photoreceptor drum 10. Further, for eliminating hysteresis of preceding image forming which remains on the photoreceptor, the circumferential surface of the photoreceptor is neutralized by exposure conducted by pre-charging uniform exposure unit 12*e* employing, for example, a light emitting diode, and superposed color toner images which are supposed to be an obverse side image are formed in succession in the same way as in the color image forming process mentioned above (FIG. 3(B)). In this case, image data for an obverse side image formed on the photoreceptor drum 10 are modified so that the obverse side image may be a mirror image against the reverse side image formed on the photoreceptor drum 10.

Recording sheet P representing a transfer material is fed out of sheet feed cassette 15 representing a transfer material housing means by feed out roller 15*a,* then conveyed to timing roller 15*b* which serves as a transfer material feeding means, and driven by the timing roller 15*b* to be fed to transfer area 14*b,* with the obverse side image representing a color toner image carried on the photoreceptor drum 10 and the reverse side image representing a color toner image carried on toner image receptor 14*a* both synchronized with each other.

In this case, recording sheet P is sheet-charged to the polarity identical to that of toner by sheet-charging unit 150 with a brush-shaped edge representing a transfer material charging means which is provided to face the grounded driven roller 14*e* and is capable of being brought into contact with or of leaving the toner image receptor 14*a* with supporting shaft 152 serving as a fulcrum, and is brought into contact with recording sheet P to be impressed with DC voltage identical to that of toner (negative polarity in the present embodiment), and thereby is attracted to the toner image receptor 14*a* to be conveyed to the transfer area 14*b*. By sheet-charging the recording sheet to be on polarity identical to that of toner, it is possible to prevent that the recording sheet and toner images on the toner image receptor 14*a* or the recording sheet and toner images on the photoreceptor drum 10 attract each other, and thereby to prevent that toner images are disturbed. The sheet-charging unit 150 is separated from the toner image receptor 14*a* to be in non-contact therewith simultaneously with passage of the recording sheet P.

The sheet-charging unit 150 is pulled apart from the toner image receptor 14*a* and is separated from the recording sheet P immediately before or simultaneously with the passage of the trailing edge of the recording sheet P. Further, voltage is impressed on the sheet-charging unit 150 only when the recording sheet P is conveyed, and impression of voltage on the sheet-charging unit 150 is cut simultaneously with its separation from the recording sheet P.

It is also possible to use, as a transfer material charging means, a conductive roller or a semiconductive film member or blade member which can be brought into contact with or pulled apart from the toner image receptor 14*a* and is impressed with DC voltage identical to that of toner.

In the transfer area 14*b,* obverse side images on the photoreceptor drum 10 are collectively transferred onto the upper side (obverse side) of recording sheet P by transfer unit 14*c* representing the first transfer means on which voltage with polarity opposite to that of toner (positive polarity in the present embodiment) is impressed. In this case, the reverse side images on the toner image receptor 14*a* are not transferred onto the recording sheet P but remain on the toner image receptor 14*a*. Then, reverse side images on the circumferential surface of the toner image receptor 14*a* are collectively transferred onto the lower side (reverse side) of the recording sheet P by reverse side transfer unit 14*g* representing the second transfer means impressed with voltage with polarity opposite to that of toner (positive polarity in the present embodiment) (FIG. 3(C)). For the purpose of obtaining satisfactory transferring in the case of transfer by means of transfer unit 14*c,* it is also possible to arrange so that uniform exposure may be carried out by transfer-overlapping exposure unit 12*d* employing a light emitting diode, for example, provided inside the photoreceptor drum 10 to face the transfer area 14*b*.

It is preferable for collective transfer that toner in an upper portion and toner in a lower portion of a toner layer are charged with same charging quantity to be on the same polarity, because a toner image for each color is superposed on others. From this viewpoint, two-sided image forming wherein color toner images formed on toner image receptor 14*a* are subjected to polarity conversion made by corona charging, or color toner images formed on photoreceptor drum 10 are subjected to polarity conversion made by corona charging is not preferable because toner in a lower layer is not charged sufficiently to the same polarity, resulting in improper transfer.

It is preferable to repeat reversal development on the photoreceptor drum 10, then to collectively transfer onto the toner image receptor 14*a* the color toner images with the same polarity formed to be superposed without changing their polarity, and then to collectively transfer them onto recording sheet P without changing their polarity, because this contributes to improvement of transferability for reverse side image forming. Even for obverse side image forming, it is preferable to repeat reversal development on the photoreceptor drum 10, and to collectively transfer onto recording sheet P the color toner images with the same polarity formed to be superposed without changing their polarity, because this contributes to improvement of transferability for obverse side image forming.

For the reasons mentioned above, a two-sided image forming method to form a color toner image on the obverse side of a transfer material through operation of the first transfer means by using the above-mentioned method to form an obverse side image and a reverse side image and then to form a color toner image on the reverse side of the transfer material by operating the second transfer means is preferably used, in color image forming.

Recording sheet P on which color toner images are formed on its both sides is neutralized by sheet separation AC neutralizing unit 14*h* representing a transfer material separating means, then separated from toner image receptor 14*a*, and is conveyed to fixing unit 17 representing a fixing means composed of two rollers each having therein a heater. Toners sticking to the obverse side and the reverse side of recording sheet P are fixed when they are heated and pressurized between fixing roller 17*a* serving as a obverse side image fixing roller and pressure roller 17*b* serving as a reverse side image fixing roller both provided on the fixing unit 17, then the recording sheet P on which images are recorded on its both sides is reversed in terms of the obverse side image and the reverse side image, and is ejected by exit roller 18 to a tray located outside the apparatus.

Toner staying on the circumferential surface of the toner image receptor 14*a* after transferring is removed by toner image receptor cleaning blade 141 which is provided on toner image receptor cleaning unit 140 representing a toner image receptor cleaning means provided to face driven roller 14*e* through toner image receptor 14*a*, and can be brought into contact with and can be pulled apart from the toner image receptor 14*a* with supporting shaft 142 serving as a fulcrum.

Toner staying on the circumferential surface of the photoreceptor drum 10 after transferring is subjected to neutralizing conducted by photoreceptor drum AC neutralizing unit 16, and then arrives at cleaning unit 19 representing an image carrier cleaning means where it is removed by rubber cleaning blade 19*a* which contacts the surface of photoreceptor drum 10 to be collected in an unillustrated waste toner container by screw 19*b*. The photoreceptor drum 10 from which residual toner is removed by the cleaning unit 19 is subjected to uniform charging conducted by scorotron charging unit 11 for Y to be ready for the following image forming cycle.

The method mentioned above, when it is used, makes it possible to conduct two-sided color image forming wherein color doubling, toner scattering and rubbing on color images on toner image receptor 14*a* are hardly caused and image deterioration is less, because superposed color toner images are collectively transferred in the aforesaid method.

As is shown in FIG. 4, recording sheet P onto which toner images have been transferred on its both sides and which is conveyed by toner image receptor 14*a* is separated from the toner image receptor 14*a* by sheet separation AC neutralizing unit 14*h* and is caused to enter fixing unit 17. In this case, extended plane PL1 of a belt horizontal plane of the toner image receptor 14*a* is positioned between the center axis of fixing roller 17*a* and horizontal plane PL2 which passes through nip portion T formed by fixing roller 17*a* representing an obverse side image fixing roller provided on fixing unit 17 and by pressure roller 17*b* representing a reverse side image fixing roller and is tangent to the fixing roller 17*a,* so that the recording sheet P separated from the toner image receptor 14*a* may hit the fixing roller 17*a*. Accordingly, an intersecting point P1 of the extended plane PL1 and a circumference of the fixing roller 17*a* is positioned to be closer to the center axis of the fixing roller 17*a* than the nip portion T (the position above nip portion T in FIG. 4).

The position of the intersecting point P1 is set so that distance L1 between the nip portion and the position on the side of center axis of the fixing roller 17*a* (position above nip portion T in FIG. 4) may take the value of (1/10–3/10)×D when D represents a radius of the fixing roller 17*a*. When the distance L1 is less than (1/10)×D, the leading edge of recording sheet P fluctuates when it enters the nip portion T, causing fixing creases. When the distance L1 exceeds (3/10)×D, on the other hand, the fixing roller 17*a* and the recording sheet p rub each other and toner images of the obverse side image are disturbed.

Radius D of fixing roller 17*a* and pressure roller 17*b* which are used normally is about 10–30 mm, and a radius of drive roller 14*d* used for toner image receptor 14*a* is about 10–20 mm. Distance L2 between the vertical plane at an end portion of the fixing roller 17*a* and the vertical plane at an end portion of the drive roller 14*d* facing the fixing roller 17*a* is set to 20–50 mm for the better passage of recording sheet P.

When recording sheet P hits fixing roller 17*a*, the recording sheet P is bent when it is conveyed to nip portion T of fixing unit 17. Since the recording sheet P is forwarded to the nip portion Y and is moved downward at the end portion of the toner image receptor 14*a* in FIG. 4, the recording sheet P is brought into close contact with the toner image receptor 14*a* when it is conveyed.

Due to the foregoing, a transfer material is caused to enter a fixing means without being creased, and toner images on both sides of the transfer material are fixed satisfactorily. When a transfer material is conveyed to a fixing unit from the second belt-shaped image carrying means, the transfer material touches less the second transfer means and a transfer material separating means, resulting in toner images of the obverse side image which are not disturbed.

Incidentally, it is also possible to provide heat shielding plate 17*d* shown with dotted lines between fixing unit 17 and toner image receptor 14*a* to prevent deformation and deterioration of the toner image receptor 14*a* caused by heat generated by the fixing unit 17.

To prevent creases caused in the course of conveying recording sheet P through fixing unit 17, pressure roller 17*b* of the fixing unit 17 is made to be straight in terms of shape and fixing roller 17*a* is made to be of a shape of a reversed crown which is hourglass-shaped from the center, and thereby generation of creases on recording sheet P in the course of fixing is prevented. In this case, it is preferable that an amount of an inclination from the center toward the both ends represented by the hourglass-shaped reversed crown of the fixing roller 17*a* is 1.5–5.0 $\mu$m/cm. When it is smaller than 1.5 $\mu$m/cm, creases tend to be caused on both sides of recording sheet P, while when it is greater than 5.0 $\mu$m/cm, creases caused by a difference of speed between the central portion and an edge portion of the recording sheet P tend to appear.

Recording sheet P is caused to pass through fixing unit 17 intermittently in the case of two-sided image forming which requires heat capacity for fixing, while the recording sheet P is caused to pass continuously in the case of obverse side image forming for only one side by photoreceptor drum 10. In any case, it is preferable that fixing roller 17*a* which fixes an obverse side image has high heat conductivity and large heat capacity. As shown in FIG. 6, fixing unit 17 comprises hard roller 17*a* and pressure roller 17*b*. Hard roller 17*a* includes metallic roller member 171*a* which is preferably of steel or aluminum, and is coated with Teflon. Pressure roller 17*b* comprises rubber roller 172*b* which is formed on metallic (preferably aluminum) pipe 172*a*. Rollers 17*a* and 17*b* are positioned so that an appropriate nip portion is obtained due to deformation of rubber roller 172*b*. Each roller member is provided therein with halogen heater 17*c* generating heat for fixing.

Due to a hard roller which is used as an obverse side image fixing roller as stated above, the obverse side image fixing roller is not scratched even when it is hit by a recording sheet or OHT used as a transfer material. In addition, due to a soft roller used as a reverse side image fixing roller, a width of a nip portion is increased to realize excellent fixing.

Figure 7:
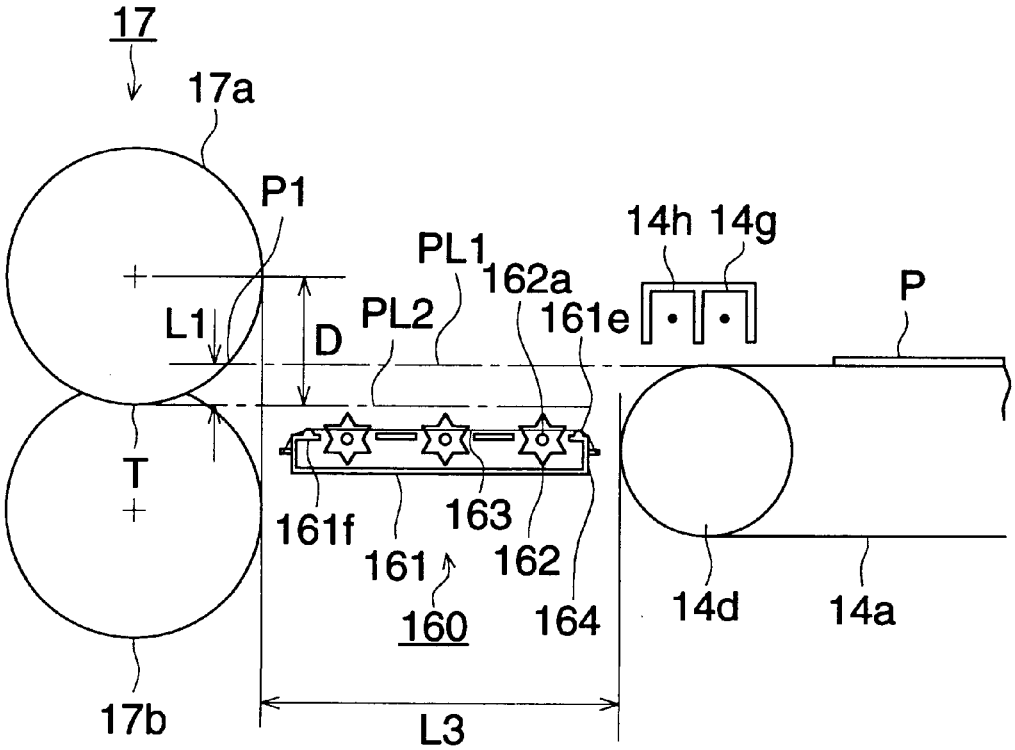
FIG. 7 is a diagram showing a conveyance section and the position where the conveyance section is arranged.
Figure 8:
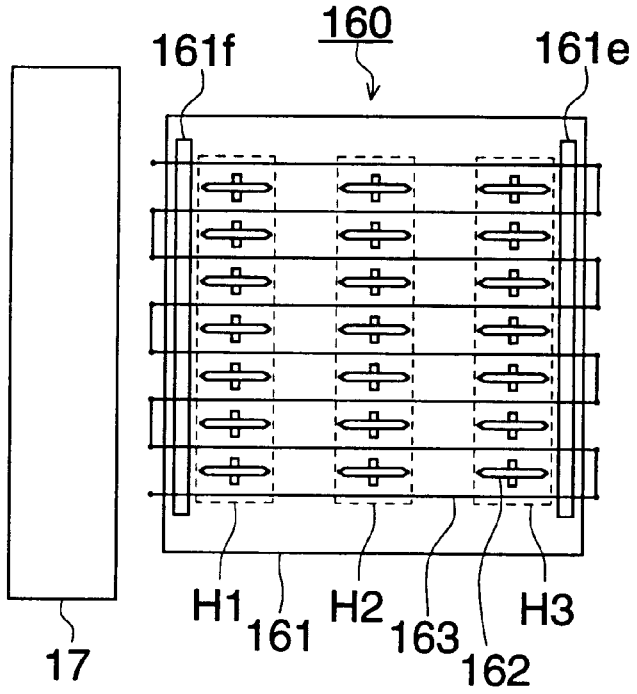
FIG. 8 is a top view of the conveyance section in FIG. 7.
Figure 9:
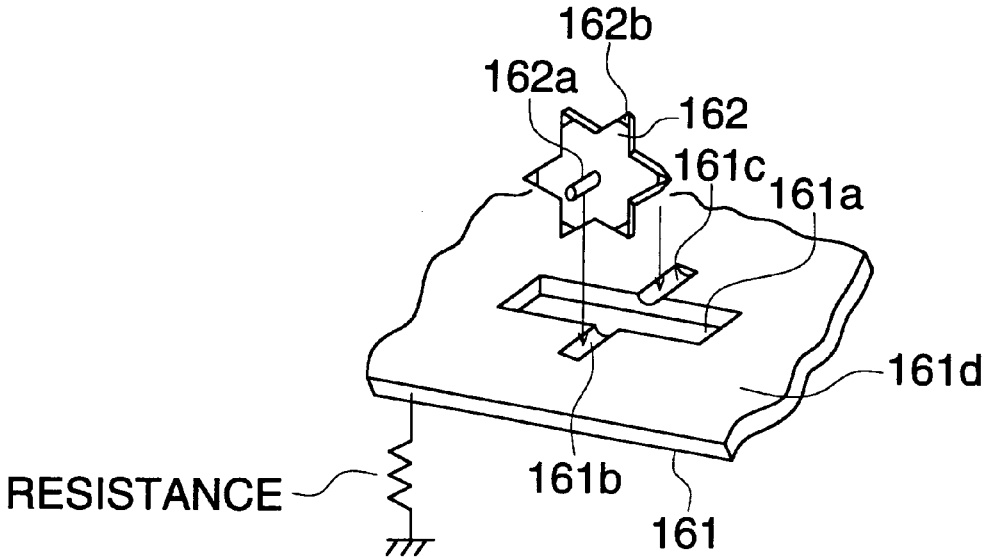
FIG. 9 is a perspective view of a spur wheel.

A conveyance section provided between the second image carrying means and a fixing means in the image forming apparatus described above will be explained as follows, referring to FIGS. 7–9. FIG. 7 is a diagram showing the conveyance section and its location, while FIG. 8 is a top view of the conveyance section in FIG. 7 and FIG. 9 is a perspective view of a spurred wheel.

In the image forming apparatus explained in FIGS. 1–6 mentioned above, conveyance section 160 is provided between toner image receptor 14*a* representing the second image carrying means and fixing unit 17 representing a fixing means, and the conveyance section 160 conveys recording sheet P representing a transfer material from toner image receptor 14*a* to fixing unit 17.

Recording sheet P on which color toner images are formed on its both sides is separated from toner image receptor 14*a*, and is conveyed to fixing unit 17 representing a fixing means composed of two rollers each being provided therein with a heater through conveyance section 160 provided with spurred wheel 162. Toners sticking to both sides of the recording sheet P are fixed by heat and pressure applied to the recording sheet P positioned between fixing roller 17*a* and pressure roller 17*b*, and then the recording sheet P is ejected to a tray located outside the apparatus.

As shown in FIG. 7, the positional relation between toner image receptor 14*a* and fixing unit 17 is the same as that explained in FIG. 4. The extended plane PL1 of toner image receptor 14*a* is between the center axis of fixing roller 17*a* and horizontal plane PL2 which passes through nip portion T and is tangent to fixing roller 17*a*. Intersecting point P1 of extended plane PL1 and the circumference of fixing roller 17*a* is closer to the center axis of fixing roller 17*a* than to nip portion T. Preferably, intersecting point P1 is located so that distance L1 between the nip portion and the center axis of fixing roller 17*a* is from 1/10 to 3/10 times D, when D represents the radius of fixing roller 17*a*. It is also desirable that top of spurred wheel 162 on conveyance section 160 is below the plane of the inlet section of the nip portion; more preferably, it is below plane PL2, i.e. closer to the center axis of pressure roller 17*b* than to nip portion T. This prevents that the transfer material conveyed by the spurred wheel from hanging down.

It is more preferable that the position of a pointed head of spurred wheel 162 being on the side of transfer material conveyance is located in the vicinity of the center axis of drive roller 14*d* for toner image receptor 14*a*. Due to this, toner images of a reverse side image on the transfer material are less rubbed and disturbed by the spurred wheel.

In the same way as in the foregoing, fixing rollers 17*a* and pressure rollers 17*b* each having a radius of 10–30 mm are usually used, and drive rollers 14*d* for toner image receptor 14*a* each having a radius of 10–20 mm are usually used, and distance L3 between the vertical plane passing the end portion of fixing roller 17*a* and the vertical plane passing the end portion of drive roller 14*d* facing the fixing roller 17*a* where conveyance section 160 is located is set to 40–100 mm so that recording sheet P may pass smoothly.

As shown in FIG. 7 or in FIG. 9, conveyance section 160 is composed of casing 161, a plurality of spurred wheels 162 mounted on the casing 161 and wire 163 spread over the casing 161. Top portion 161*d* of the casing 161 is provided thereon with rectangular hole 161*a* which is further provided on its both edges with grooves 161*b* and 161*c* respectively. Spurred wheel 162 is embedded in the rectangular hole 161*a* in a way that supporting shaft 162*a* provided on the center of the spurred wheel 162 is engaged with grooves 161*b* and 161*c* on both edges of the rectangular hole 161*a*, thus the spurred wheel 162 is rotatably mounted on the casing 161.

As shown in FIG. 7 or in FIG. 8, wire 163 is spread over the casing 161 using pins 164, and in this case, rib portions 161*e* and 161*f* on the casing 161 cause the wire 163 representing a guide to be spread above the supporting shaft 162*a* which is a rotary center of the spurred wheel 162.

As shown in FIG. 9, the spurred wheel 162 preferably is 0.05–0.5 mm in terms of thickness and 5–25 mm in terms of outside diameter, and it is, for example, an etched metal sheet of stainless steel or copper with a thickness of 0.2 mm which is formed to be a hexagonal shape having an outside diameter of 10 mm and sharp projections 162*b*. This metal sheet is grounded through the resistor with $10^{10}$–$10^{14}\Omega$. The reason why the spurred wheel 162 is grounded through a metal sheet or a high resistor or by the use of a highly resistant member is to prevent toner sticking caused by charge accumulation of the spurred wheel 162 and to prevent disturbance of toner images, because toner and a transfer material have electric charges.

When recording sheet P on which toner images have been transferred is conveyed to conveyance section 160, the leading edge of the recording sheet P is lifted by wire 163 spread to be higher than supporting shaft 162*a* representing the rotary center of spurred wheel 162, and is conveyed to the spurred wheel 162, during which toner images are not rubbed. Then, the spurred wheel 162 is driven to rotate while its projections 162*b* come in contact with or stick into the recording sheet P, thus the recording sheet P is conveyed to fixing unit 17. Further, wire 163 representing a guide member spread to be higher than supporting shaft 162*a* which is a rotary center of the spurred wheel 162 prevents the trailing edge of the recording sheet P from being hung down, and thereby no toner images are rubbed. Even when recording sheet P on which toner images are formed on its lower side is conveyed, the toner images are not rubbed when the recording sheet P is conveyed.

It is preferable for conveying a transfer material smoothly that there are provided a plurality of spurred wheel sets H1, H2 and H3 each set being composed of plural spurred wheels arranged in parallel in the longitudinal direction of fixing unit 17 as shown in FIG. 8.

The invention makes it possible that a transfer material is caused to enter a fixing means without being creased. In addition, when a transfer material is conveyed from the second belt-shaped image carrying means to a fixing means, the transfer material less comes in contact with the second transfer means and a transfer material separating means.

Toner images of a reverse side image of a transfer material which is conveyed by spurred wheels are less rubbed by the spurred wheels.

Due to a hard roller which is used as an obverse side image fixing roller as stated above, the obverse side image fixing roller is not scratched even when it is hit by a recording sheet or OHT used as a transfer material. In addition, due to a soft roller used as a reverse side image fixing roller, a width of a nip portion is increased to realize excellent fixing.

Figure 10:
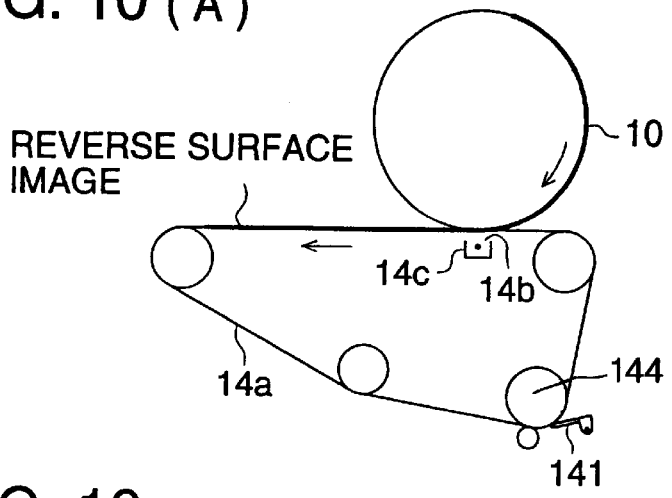
FIGS. 10(A) to 10(C) diagrams showing how toner images on both sides are formed in an image forming apparatus related to the invention.
Figure 10:
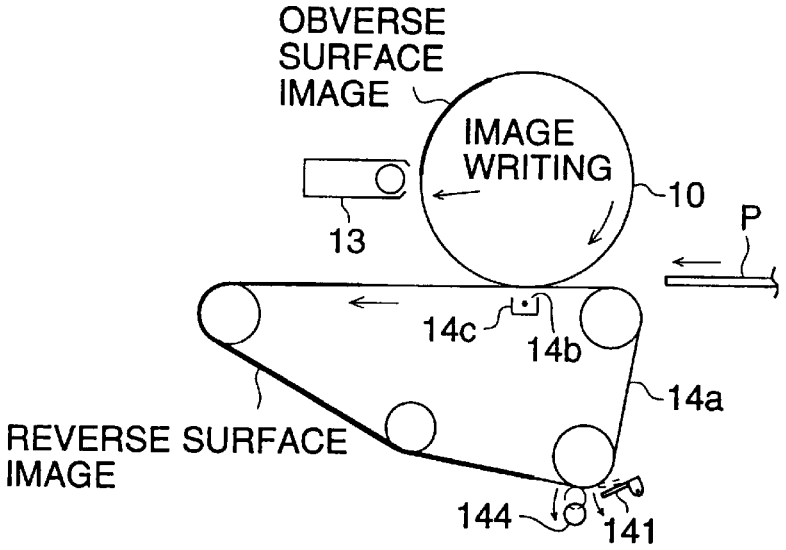
Figure 10:
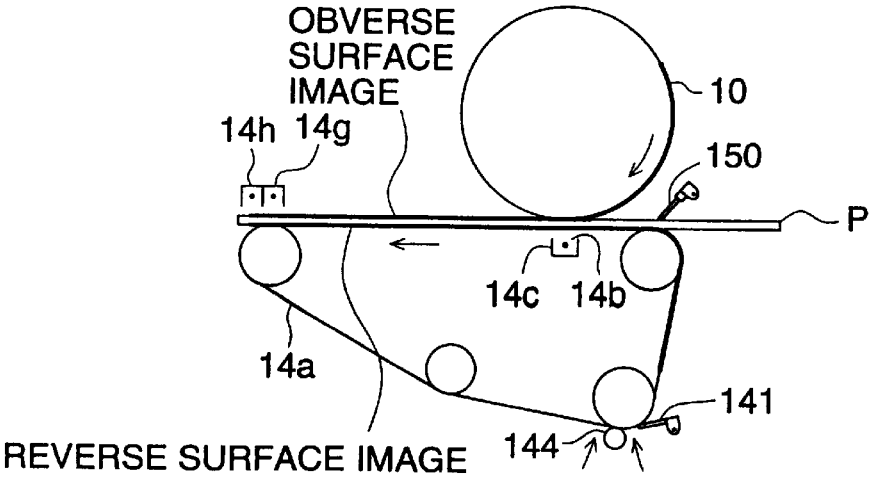

Next, the structure of the cleaning means will be explained. As shown in FIG. 10(A), toner image receptor cleaning blade 141 and cleaning roller 144 are both brought into contact with toner image receptor 14*a* while the reverse toner image is transferred from first image carrier means 10 to toner image receptor 14*a*. They are drawn apart, as shown in FIG. 10(B) before the reverse toner image on toner image receptor 14*a* passes the position of cleaning roller 144. Then they are brought back into contact with toner image receptor 14*a*, as shown in FIG. 10(C), immediately after the reverse toner image has passed so that any undesired residual toner is removed by cleaning blade 141 and cleaning roller 144. Cleaning blade 141 and cleaning roller 144 are separated from toner image receptor 14*a*, as in FIG. 10(B), immediately after the trailing edge of the residual toner of the reverse side image has passed cleaning blade 141 and before the leading edge of the following reverse toner image reaches cleaning roller 144.

Toner image receptor 14*a* is provided to be close to or to be in contact with photoreceptor drum 10, drive roller 14*d* is arranged at the downstream side from the position where the toner image receptor 14*a* is provided to be close to or to be in contact with photoreceptor drum 10 in the rotary direction of the toner image receptor 14*a*, and driven roller 14*e* is arranged at the upstream side from the aforesaid position for being close or being in contact in the rotary direction of the toner image receptor 14*a*. Further, guide roller 14*f* is arranged at the downstream side from the driven roller 14*e* in the rotary direction of the toner image receptor 14*a* to be inscribed in the belt-shaped toner image receptor 14*a*, respectively. Paper charging unit 150 which makes recording sheet P to be attracted to the toner image receptor 14*a* is provided to face the driven roller 14*e* through the toner image receptor 14*a*, and toner image receptor cleaning blade 141 provided on toner image receptor cleaning unit 140 which cleans the toner image receptor 14*a* is provided to face guide roller 14*f* arranged to be away from the driven roller 14*e* through an inbetween of the toner image receptor 14*a*.

Due to this, a shock generated when the second image carrying means cleaning blade is brought into contact with or is drawn apart from the second image carrying means is not transmitted to the second image carrying means directly through the driven roller, and thereby uneven rotation of the second image carrying means is toned down. Further, contamination on a transfer material charging means caused by the toner spattered from the second image carrying means cleaning means can be prevented, because the transfer material charging means is arranged to be away from the second image carrying means cleaning means. Since the uneven rotation of the second image carrying means is prevented, blurred images are not caused on toner images of an obverse side image or a reverse side image transferred onto a transfer material conveyed by the second image carrying means, thus excellent images can be formed.

Figure 11:
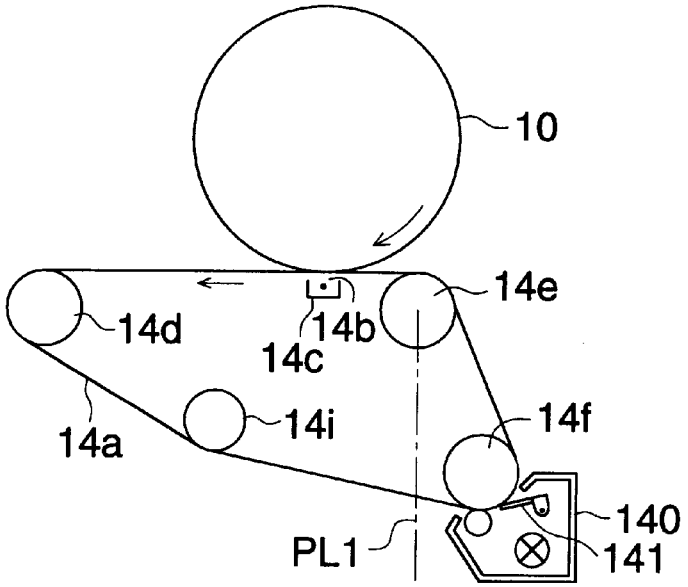
FIG. 11 is a diagram showing an example of preferable arrangement for a driven roller and a guide roller.
Figure 12:
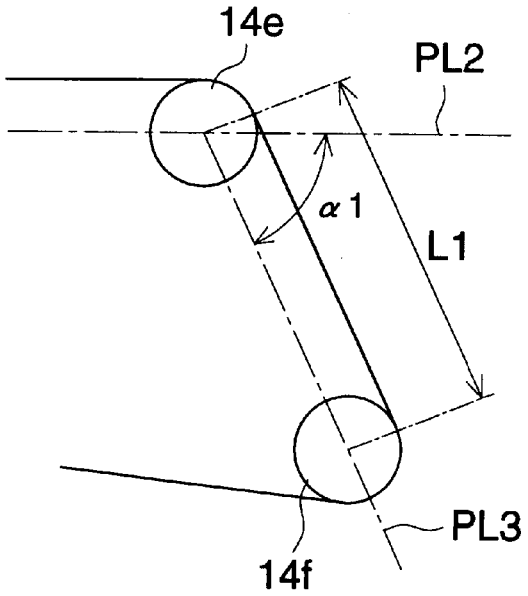
FIG. 12 is a diagram showing dimensions related to the primary sections in FIG. 11.

FIGS. 11 and 12 show examples of preferable arrangement of the driven roller and the guide roller. FIG. 11 is a diagram showing an example of preferable arrangement of the driven roller and the guide roller, while FIG. 12 is a diagram showing related dimensions of primary portions in FIG. 11.

In the same way as in the foregoing, the toner image receptor 14*a* is trained so that drive roller 14*d*, driven roller 14*e* and guide roller 14*i* are inscribed in the toner image receptor 14*a*.

Toner image receptor 14*a* is provided to be close to or to be in contact with photoreceptor drum 10, drive roller 14*d* is arranged at the downstream side from the position where the toner image receptor 14*a* is provided to be close to or to be in contact with photoreceptor drum 10 in the rotary direction of the toner image receptor 14*a*, and driven roller 14*e* is arranged at the upstream side from the aforesaid position for being close or being in contact in the rotary direction of the toner image receptor 14*a*. Further, guide roller 14*f* is arranged at the upstream side (below the driven roller 14*e* in FIG. 11) from the driven roller 14*e* in the rotary direction of the toner image receptor 14*a* to be inscribed in the belt-shaped toner image receptor 14*a*, respectively, and paper charging unit 150 which makes recording sheet P to be attracted to the toner image receptor 14*a* is provided to face the driven roller 14*e* through the toner image receptor 14*a*. Toner image receptor cleaning unit 140 which cleans the toner image receptor 14*a* is provided to face the guide roller 14*f* arranged to be away from the driven roller 14*e*, and it is preferable, as shown in FIG. 11, that a straight line passing through the center axis of the driven roller 14*e* and that of the guide roller 14*f* forms an angle of ±45° with vertical line PL1 passing through the center axis of the driven roller 14*e* in FIG. 11.

Due to the foregoing, the guide roller 14*f* can be arranged in a way that transfer unit 14*c* located between the drive roller 14*d* and the driven roller 14*e* inside the toner image receptor 14*a* does not interfere with the guide roller 14*f*. In addition to this, a belt length of the toner image receptor 14*a* can be set to be longer in the similar space.

The drive roller 14*d*, the driven roller 14*e* and the guide roller 14*f* which are usually used have a diameter of 10–35 mm, and distance L1 between centers of both rollers which is 25–60 mm is preferable. When this distance exceeds 60 mm, a belt structure for the toner image receptor 14*a* is required to be greater, while when it is less than 25 mm, a shock generated when toner image receptor cleaning blade 141 comes in contact or is drawn apart is not absorbed properly.

Further, it is preferable that angle $\alpha 1$ formed by straight line PL2 passing through the center axis of the drive roller 14*d* and that of the driven roller 14*e* and by straight line PL3 passing through the center axis of driven roller 14*e* and that of the guide roller 14*f* is (90±45)°. When the angle exceeds 135°, a belt structure for the toner image receptor 14*a* is required to be greater, while when it is less than 45°, the guide roller 14*f* interferes with transfer unit 14*c*. When the toner image receptor cleaning unit 140 is positioned at the lower portion, it is easy to collect toner utilizing toner falling, which is an advantage. For installation of the toner image receptor cleaning unit 140, angle $\alpha 1$ which is not than 90° is more preferable.

Figure 13:
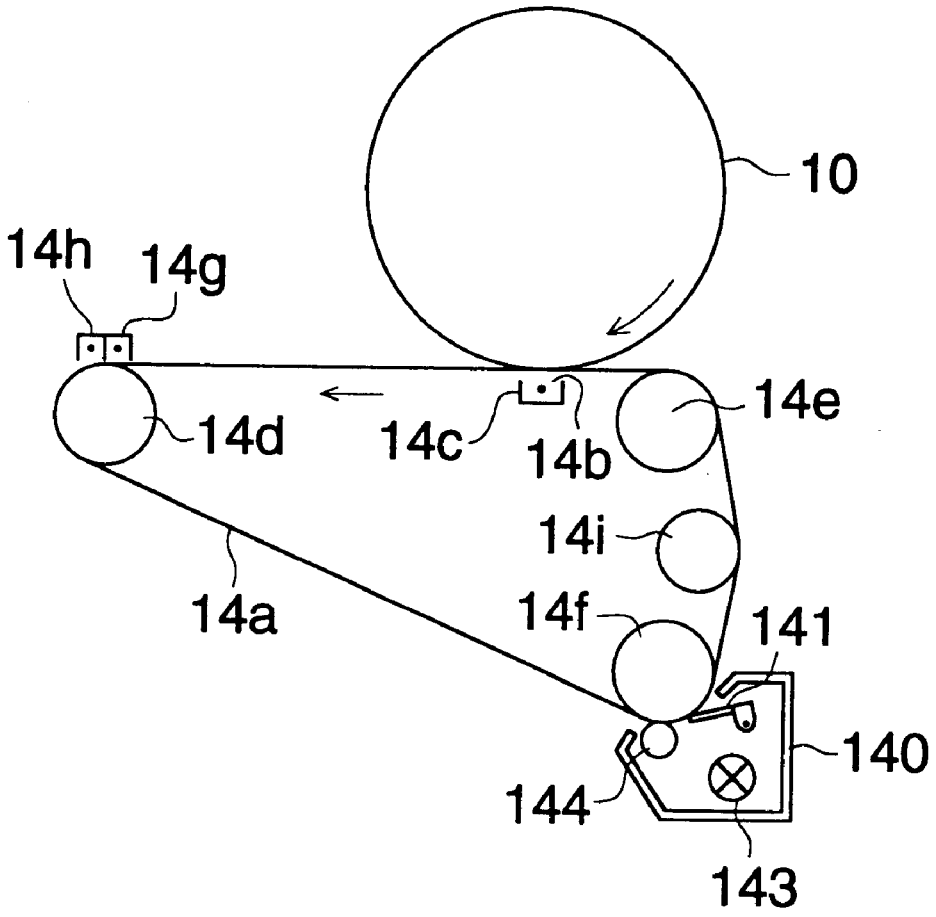
FIG. 13 is a diagram showing another example of arrangement of a tension roller.

FIG. 13 shows another example of arrangement of a tension roller.

In the same way as in that explained in FIG. 11, toner image receptor 14*a* is trained so that drive roller 14*d*, driven roller 14*e*, guide roller 14*f* and tension roller 14*i* may be inscribed in the toner image receptor 14*a*, in which the tension roller 14*i* is provided between the driven roller 14*e* and the guide roller 14*f*. The relative locations of driven roller 14*e* and guide roller 14*f*, and paper charging unit 150 and cleaning unit 140, are the same as explained with regard to FIG. 1, FIG. 4, and FIG. 5. The paper charging unit 150 is provided to face the driven roller 14*e*, and the toner image receptor cleaning unit 140 is provided below the guide roller 14*f* to face it, and the paper charging unit 150 and toner image receptor cleaning blade 141 provided on the toner image receptor cleaning unit 140 are made to be capable of coming in contact with or being drawn apart from the toner image receptor 14*a*.

Due to tension roller provided between the driven roller and the guide roller, a shock generated when the second image carrying means cleaning blade is brought into contact with or is drawn apart from the second image carrying means is absorbed by the tension roller, and whereby uneven rotation of the second image carrying means is further prevented.

Accordingly, uneven rotation of the second image carrying means caused by a shock generated when the second image carrying means cleaning blade is brought into contact with or is drawn apart from the second image carrying means is toned down, and contamination on a transfer material charging means caused by the toner spattered from the second image carrying means cleaning means is prevented, because the transfer material charging means is arranged to be away from the second image carrying means cleaning means.

In particular, uneven rotation of the second image carrying means caused by a shock generated when the second image carrying means cleaning blade is brought into contact with or is drawn apart from the second image carrying means is prevented.

In the invention, toner leaving the second image carrying means cleaning blade can be collected in the second image carrying means cleaning means without scattering outside.

What is claimed is:

1. An apparatus for forming a toner image on both sides of a sheet, comprising:

first image carrying means on which a first toner image and a second toner image are formed by toner image forming means;

belt-shaped second image carrying means onto which the second toner image is transferred from the first image carrying means;

first transferring means for transferring the first toner image from the first image carrying means to a first side of a sheet;

second transferring means for transferring the second toner image from the belt-shaped second image carrying means to a second side of the sheet;

fixing means having a first fixing roller for fixing the first toner image onto the first side of the sheet and a second fixing roller for fixing the second toner image onto the second side of the sheet, the first fixing roller coming in contact with the second fixing roller so as to form a nip section therebetween;

the belt-shaped second image carrying means having a flat belt surface on which the sheet is conveyed from the first image carrying means toward a separating section at which the sheet is separated from the belt-shaped second image carrying means, wherein the separating section is located on the end portion of the belt-shaped second image carrying means at the fixing means-side; and the belt-shaped second image carrying means arranged in relation to the fixing means in such a manner that an extended plane from the flat belt surface crosses the first fixing roller at a point between the nip section and a rotation axis of the first fixing roller, wherein the first fixing roller has a radius D and the crossing point is positioned between said rotation axis and the nip section by a distance of 1/10 to 3/10 D from said rotation axis.

2. The apparatus of claim 1, wherein the first fixing roller is a hard roller and the second fixing roller is a soft roller.

3. The apparatus of claim 1, wherein the separating section is provided with a separating electrode to separate the sheet from the belt-shaped second image carrying means, the separating electrode provided so as to face the flat belt surface between the first image carrying means and the fixing means and a transfer electrode of the second transferring means provided so as to face the flat belt surface between the first image carrying means and the separating electrode.

4. An apparatus for forming a toner image on both sides of a sheet, comprising:

first image carrying means on which a first toner image and a second toner image are formed by toner image forming means;

belt-shaped second image carrying means onto which the second toner image is transferred from the first image carrying means;

first transferring means for transferring the first toner image from the first image carrying means to a first side of a sheet;

second transferring means for transferring the second toner image from the belt-shaped second image carrying means to a second side of the sheet;

fixing means having a first fixing roller for fixing the first toner image onto the first side of the sheet and a second fixing roller for fixing the second toner image onto the second side of the sheet, the first fixing roller coming in contact with the second fixing roller so as to form a nip section therebetween;

the belt-shaped second image carrying means having a flat belt surface on which the sheet is conveyed from the first image carrying means toward a separating section at which the sheet is separated from the belt-shaped second image carrying means, wherein the separating section is located on the end portion of the belt-shaped second image carrying means at the fixing means-side;

the belt-shaped second image carrying means arranged in relation to the fixing means in such a manner that an extended plane from the flat belt surface crosses the first fixing roller at a point between the nip section and a rotation axis of the first fixing roller, and a spur wheel which conveys the sheet from the belt-shaped second image carrying means to the fixing means is below a plane parallel to a part of the extended plane and including the inlet of the nip section.

5. An apparatus for forming a toner image on both sides of a sheet, comprising:

first image carrying means on which a first toner image and a second toner image are formed by toner image forming means;

belt-shaped second image carrying means onto which the second toner image is transferred from the first image carrying means;

first transferring means for transferring the first toner image from the first image carrying means to a first side of a sheet;

second transferring means for transferring the second toner image from the belt-shaped second image carrying means to a second side of the sheet;

fixing means having a first fixing roller for fixing the first toner image onto the first side of the sheet and a second fixing roller for fixing the second toner image onto the second side of the sheet, the first fixing roller coming in contact with the second fixing roller so as to form a nip section therebetween;

the belt-shaped second image carrying means having a flat belt surface on which the sheet is conveyed from the first image carrying means toward a separating section at which the sheet is separated from the belt-shaped second image carrying means, wherein the separating section is located on the end portion of the belt-shaped second image carrying means at the fixing means-side;

the belt-shaped second image carrying means arranged in relation to the fixing means in such a manner that an extended plane from the flat belt surface crosses the first fixing roller at a point between the nip section and a rotation axis of the first fixing roller, and wherein the belt-shaped second image carrying means comprises an endless belt which is rotatable in a rotating direction and is in contact with or in close proximity to the first image carrying means thus forming a first transfer section, a driving roller located downstream of the first transfer section, in said rotating direction, a driven roller upstream of the first transfer section in an opposite direction to said rotating direction, and a guide roller located upstream of the driven roller in said opposite direction, wherein the belt-shaped second image carrying means further comprises a cleaning blade for cleaning the endless belt and the cleaning blade is arranged opposite the guide roller.

6. The apparatus of claim 5, further comprising a sheet-charging means, provided opposite to the driven roller, for charging the sheet so as to be attracted to the belt-shaped second image carrying means.

7. The apparatus of claim 5, wherein the belt-shaped second image carrying means further comprises a tension roller provided between the driving roller and the guide roller or between the driven roller and the guide roller.

8. The apparatus of claim 5, wherein the cleaning blade is located beneath the guide roller.

* * * * *